US011066780B2

(12) United States Patent
Alavian

(10) Patent No.: US 11,066,780 B2
(45) Date of Patent: Jul. 20, 2021

(54) PROTECTIVE LAYER FOR IRONING BOARD

(71) Applicant: Oliver A. Alavian, Mission Viejo, CA (US)

(72) Inventor: Oliver A. Alavian, Mission Viejo, CA (US)

( * ) Notice: Subject to any disclaimer, the term of this patent is extended or adjusted under 35 U.S.C. 154(b) by 1 day.

(21) Appl. No.: 16/435,574

(22) Filed: Jun. 10, 2019

(65) Prior Publication Data

US 2019/0292717 A1 Sep. 26, 2019

Related U.S. Application Data

(63) Continuation-in-part of application No. 15/886,491, filed on Feb. 1, 2018, now Pat. No. 10,590,596.

(51) Int. Cl.
*D06F 83/00* (2006.01)

(52) U.S. Cl.
CPC ..... *D06F 83/00* (2013.01)

(58) Field of Classification Search
CPC ..... D06F 83/00; D06F 81/00; D06F 85/00; D06F 71/36
See application file for complete search history.

(56) References Cited

U.S. PATENT DOCUMENTS 1,485,824 A * 3/1924 Bass ..... D06F 83/00 38/16
1,538,722 A * 5/1925 Merrick ..... D06F 83/00 38/140
2,264,644 A * 12/1941 Santangelo ..... D06F 83/00 38/66
2,325,493 A * 7/1943 Fay ..... D06F 81/10 38/137
3,484,965 A * 12/1969 Muniz ..... D06F 71/32 38/15
4,535,921 A * 8/1985 Sanders ..... D06F 81/00 220/480
4,647,487 A * 3/1987 O'Neill ..... D06F 83/00 38/140
5,371,961 A * 12/1994 Mattesky ..... D06F 83/00 38/140
5,392,543 A * 2/1995 Lehrman ..... D06F 83/00 38/140
6,349,490 B1 * 2/2002 Gross ..... D06F 83/00 38/137

* cited by examiner

*Primary Examiner* — Ismael Izaguirre
(74) *Attorney, Agent, or Firm* — Lazaris IP

(57) ABSTRACT

A protective layer for an ironing board comprises an overlay portion and an edge that extends over an entirety of sides of a top surface of an ironing board to prevent slippage of the protective layer from the ironing board. The protective layer includes a plurality of tabs extending from the edge, each tab having a hole positioned therein for hanging items from the protective layer. The protective layer is stretchable to fit over the top surface of an ironing board, and the plurality of tabs are positioned on each elongated side of the protective layer and on a back portion thereof. The protective layer may be part of an ironing board cover that includes a padded textile base section to form a smooth, heat-reflective and secure ironing surface.

11 Claims, 7 Drawing Sheets

PROTECTIVE LAYER FOR IRONING BOARD

CROSS-REFERENCE TO RELATED APPLICATION(S)

This patent application claims priority to, and is a continuation-in-part of, U.S. non-provisional application Ser. No. 15/886,491, filed on Feb. 1, 2018, the contents of which are incorporated in their entirety herein. In accordance with 37 C.F.R. § 1.76, a claim of priority is included in an Application Data Sheet filed concurrently herewith.

FIELD OF THE INVENTION

The present invention relates to ironing boards. Specifically, the present invention relates to a protective layer that is universally applicable to all existing commercial ironing boards.

BACKGROUND OF THE INVENTION

Many types of covers for ironing boards for commercial, residential or home use exist in the marketplace. However, existing covers are not designed to fit the multiple sizes and shapes of existing ironing boards, so as to be easily affixable to any ironing board. This means that consumers often need to purchase a cover that fits a specific ironing board when their current cover becomes damaged or no longer usable. One reason for this is that many existing covers are multi-piece constructions made so that the cover can conform to the shapes of ironing boards rather than the size.

These multi-piece constructions include a pocket configured for the "nose" area of most ironing boards, and therefore must include at least two portions: a main portion for wide part of an ironing board, and a tapered pocket that fits over the nose. These multi-piece constructions make covers difficult to fit over multiple ironing board sizes, are also more expensive to manufacture and assemble.

Accordingly, there is a need in the existing art for an ironing board cover that is a one-piece construction and which is easily configurable so that it fits the shape and size of many existing ironing boards.

BRIEF SUMMARY OF THE INVENTION

Accordingly, it is one objective of the present invention to provide an ironing board cover configured to be placed on ironing board having multiple shapes and sizes in an entirely one-piece construction. It is another objective of the present invention to provide an ironing board cover configured in an entirely one-piece construction. It is still another objective of the present invention to provide multiple layers of material in an ironing board cover, to form a smooth, heat-reflective ironing surface. It is still another objective of the present invention to provide at least one layer of material allows heat from evaporated steam to be transferred back upward into a garment as it is being ironed. It is a further objective of the present invention to provide an ironing board cover configured with an adjustable bungee fastening mechanism to allow the cover to be stretched for a customized fit on any ironing board.

The present invention is a universal ironing board cover that is designed to fit multiple sizes and shapes of existing, commercially-available ironing boards. The ironing board cover is one piece of fabric, cut into an oval shape, and combines a one-piece construction and a bungee mechanism, without having to sew on multiple material together, and without an additional pocket for the "nose" area of the ironing board. The ironing board cover includes multiple layers of material, such as for example textiles that may include cotton and wool, and other materials that may include foam, fiber, titanium, ceramic, as well as an interlay of aluminum, to increase durability and providing a heat-reflective, heat-retentive, and scorch-resistant surface that makes ironing garments much easier. The ironing board cover may include a portion configured to allow an iron to lay flat on the surface while being used, thereby providing an iron resting portion may of heat-resistant materials.

In one embodiment of the present invention, an ironing board cover includes a padded textile base section comprised of multiple layers of material adhered together to form a smooth, heat-reflective ironing surface, and having a first end portion for fitting over a large end of an ironing board, a taper at a point distal to a second end portion, the second end portion for fitting over a narrow end of an ironing board, and a bottom segment having an attenuated edge. The cover also includes an elastic bungee fastening mechanism forming at least part of the attenuated edge and stretching along an entirety of the bottom segment of the padded textile base section, the adjustable elastic bungee fastening mechanism allowing the padded textile base section to be stretched, so that the padded textile base section is configured to be universally placeable on ironing boards having multiple shapes, and so that the ironing board cover is comprised of an entirely one-piece construction.

In another embodiment of the present invention an apparatus comprises a padded base section, comprised of multiple layers of material adhered together to form a smooth, heat-reflective ironing surface for an ironing board cover having an entirely one-piece construction, the padded textile base section include a textile top layer, an aluminum layer positioned between the cotton top layer to direct evaporated moisture collected from steam upwards into a garment as it is being ironed on the ironing board cover, and one or both of a foam layer and a fiber layer, wherein the padded base section includes a first end portion for fitting over a large end of an ironing board, a taper at a point distal to a second end portion, the second end portion for fitting over a narrow end of an ironing board, a bottom segment having an attenuated edge, and an iron rest an iron rest portion configured to withstand direct heat from a hot surface of an iron. The apparatus also comprises an elastic bungee fastening mechanism forming at least part of the attenuated edge and stretching along an entirety of the bottom segment of the padded base section, the elastic bungee fastening mechanism allowing the padded base section to be stretched, so that the padded textile base section is configured to be universally placeable on ironing boards having multiple shapes.

Other objects, embodiments, features and advantages of the present invention will become apparent from the following description of the embodiments, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention reference is made to the exemplary embodiments illustrating the principles of the present invention and how it is practiced. Other embodiments will be utilized to practice the present invention and structural and functional changes will be made thereto without departing from the scope of the present invention.

Figure 1:
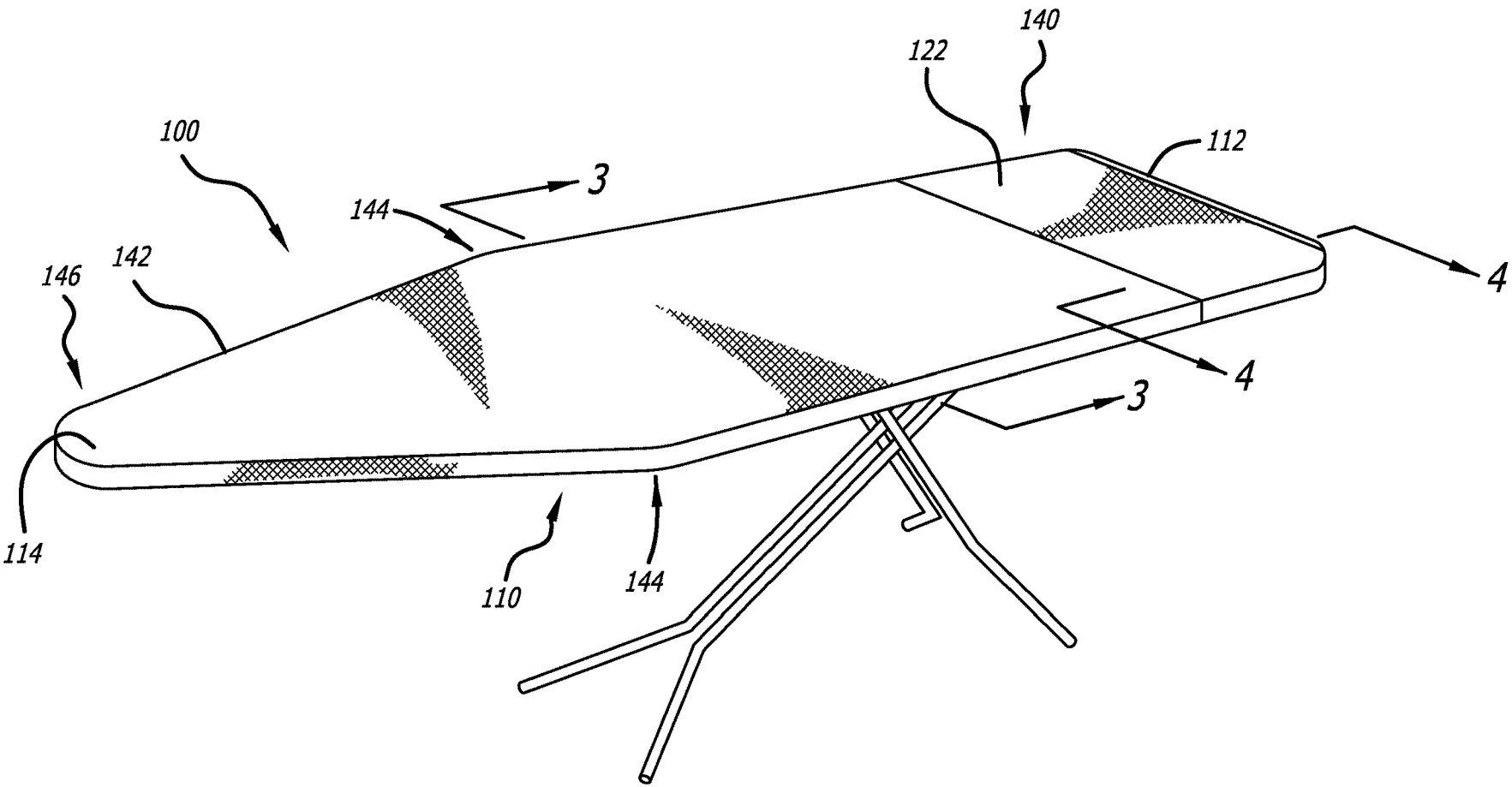
FIG. 1 is a top and side view of an ironing board having an ironing board cover according to the present invention.
Figure 2:
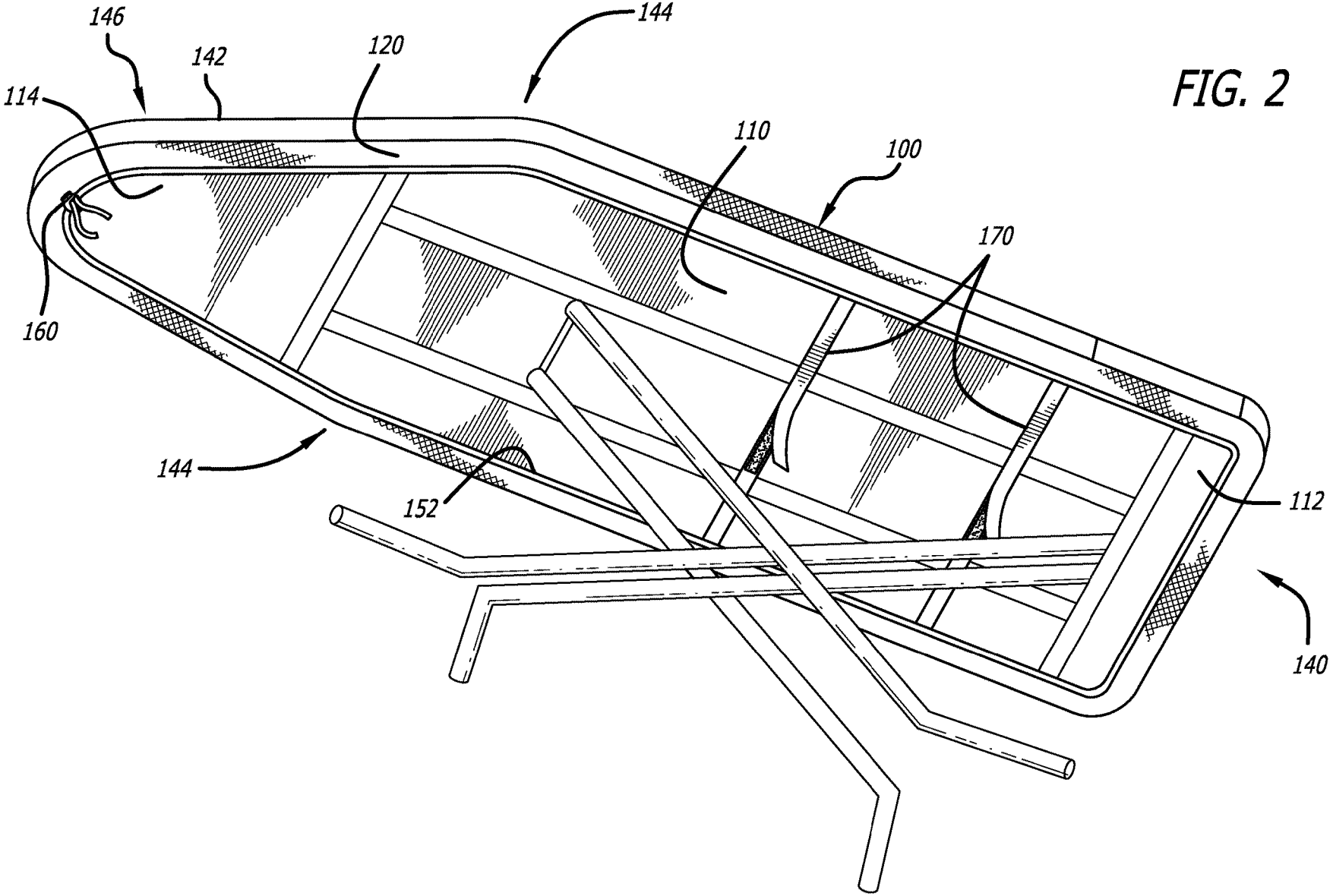
FIG. 2 is an angled bottom view of an ironing board having an ironing board cover according to the present invention.

FIG. 1 is a top and side view of an ironing board cover 100, and FIG. 2 is a bottom, angled view of the ironing board cover 100 according to the present invention. The ironing board cover 100 is a one-piece construction, designed to fit ironing boards 110 of most conventional configurations. The present invention is generally cut in a way to form to multiple shapes of existing ironing board outlines. Existing ironing board manufacturers typically design covers made from two (or more) pieces, where one portion covers the entire top, sides and back side of an ironing board. Meanwhile, the tip or nose portion of the cover has another piece sewn underneath to conform to the shape of a nose of the ironing board and provide a better fit. Often, this gives the impression of a pocket sewn to the bottom portion of the "tip" of the cover. The design of the present invention eliminates this pocket or extra piece, and is cut in an oval shape which accommodates all shapes of ironing board noses, from narrow, pointy ironing board noses to wider ones.

The ironing board cover 100 includes a base section 120 that is padded and made from materials that form multiple layers 130. The base section 120 is predominantly comprised of textiles, and may include other materials as noted below. The multiple layers 130 are adhered together in a lamination process to form a smooth, heat-reflective ironing surface when the ironing board cover 100 is fitted onto an ironing board 110.

The ironing board cover 100 has a first end portion 140, for fitting over a large end 112 of an ironing board 110, and a taper 142 at a point 144 distal to a second end portion 146. The second end portion fits over a narrow end 114 of an ironing board 110, and the taper is designed to provide shape to the cover to narrow as the ironing board 110 itself narrows toward its "nose." The ironing board cover 100 also includes a bottom segment 150, having an attenuated edge 152, within which an adjustable elastic bungee fastening mechanism 160 is positioned to form at least part of the attenuated edge 152. The adjustable elastic bungee fastening mechanism 160 is machined to stretch along an entirety of the bottom segment 150 of the padded base section 120 to allow the padded base section 120 to be adjusted to fit onto ironing boards 110 having multiple shapes.

The adjustable elastic bungee fastening mechanism 160 includes a bungee pull cord 162, which allows for the mechanism 160 to be pulled and adjusted so that ironing board cover 100 is tightly fit as desired over the ironing board 110. The pull bungee cord 162 may be adjusted and positioned at any of the front, back, or either side of the ironing board cover 100, and may include a locking mechanism which can be pinched to loosen or pull to tighten. The cord 162 may also have a pocket or strap to keep it positioned tightly against the ironing board cover 100 and out of the way.

Alternatively, one may use the ironing board cover 100 as is, without adjustment, as some tension is inherent therein. In an alternative embodiment, the adjustable elastic bungee fastening mechanism 160 includes a bungee cord 162 that is pre-set with a given tension and not adjustable. In a further alternative embodiment, the adjustable elastic bungee fastening mechanism 160 includes a draw-cord system that has no bungee. Many other adjustable fasteners are also possible, and it is therefore to be understood that any fastening mechanism may be included to give the ironing board cover 100 a customized fit over an ironing board 110.

The base section 120 of the ironing board cover 100 may also include, in one embodiment of the present invention, an iron rest portion 122, that has the capability and durability to withstand direct heat from an iron being placed on it, face down and continuously, without scorching. The iron rest portion 122 may be located at any portion of the base section 120, but preferably is positioned at one end of the base section to allow for use of the rest of the ironing board cover 100 for other activities such as positioning a garment on the board 110, or folding a garment. The iron rest portion 122 is comprised of materials in the multiple layers of materials 130 that specifically enable the cover to withstand high direct heat when applied thereto. Regardless, the iron rest portion 122 lays flat and seamless with the rest of the base portion 120, but may be designed to be distinguishable using a different color, or separated by a specifically-indicated boundary from the rest of the base section 120.

Figure 3:
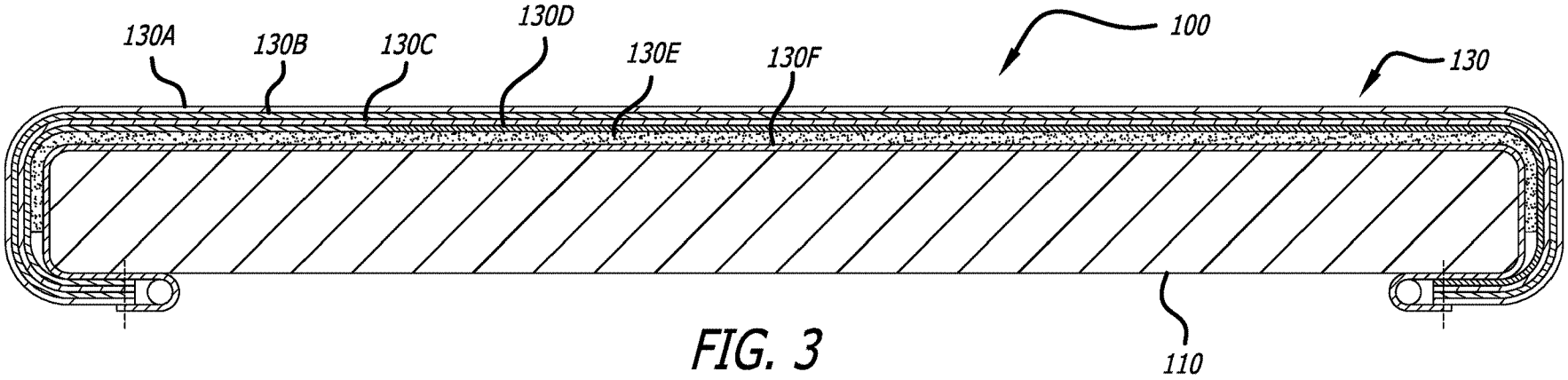
FIG. 3 is a cross-sectional view of layers in an ironing board cover as indicated in FIG. 1, according to the present invention.
Figure 4:
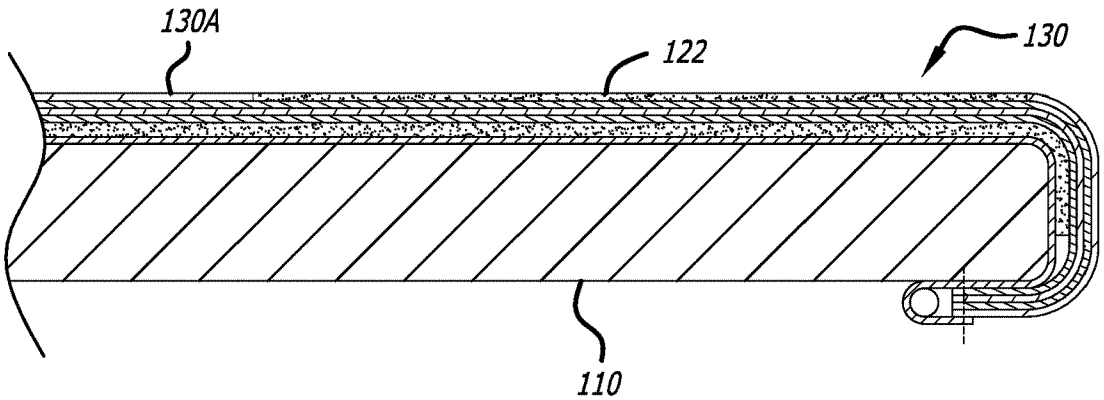
FIG. 4 is a cross-sectional view of one end of an ironing board cover as indicated in FIG. 1, according to one embodiment of the present invention.

FIG. 3 is a is a cross-sectional view of the multiple layers 130 of an ironing board cover 100. As noted above, the ironing board cover 100 is machined so as to have a one-piece construction, and the base segment 120 of the cover 100 is comprised generally of multiple layers 130 of textiles and other materials. These textiles and other materials comprising these multiple layers 130 may include a top layer 130A, cotton or treated cotton 130A, wool 130B, foam 130E, fiber 130F, aluminum 130C, felt, and other materials either in whole or in part depending on how the cover 100 is used and what type of ironing is intended for its use. The multiple layers 130 are combined and adhered or sewed together during the manufacturing process, so that all of the layers 130 are machined together, eliminating any wrinkles on a top side of the cover 100 and providing a smooth ironing surface. The multiple layers 130 may also include other metal 130D, such as titanium, and ceramic materials, machined with the textiles therein, that provide higher durability and improved heat reflection, heat retention, and scorch resistance properties for the base section 120 and the ironing board cover 100. FIG. 4 is a cross-sectional view of one end of the ironing board cover 100, showing an iron rest portion 122 as a top layer 130A.

The multiple layers 130 may also include and interlay of aluminum. The interlay of aluminum enables the ironing board cover 100 to collect steam from an iron or steamer, thereby not permitting any moisture to drip onto a floor below the ironing board 110 while an iron is in use, and also protecting the underlying ironing board from exposure to and damage from moisture caused by steam. The interlay allows the multiple layers 130 to reflect back a high level of heat onto the garment being ironed. Further, each time the iron moves across the multiple layers 130 having the aluminum interlay, it generates more heat and the collected moisture evaporates again, rising back up through the layers and from underneath the garment. This significantly reduces ironing time and produces better results in the ironed garment.

In one embodiment, surfaces of the base segment 120 may be treated with materials such as aluminum, titanium, or another metal, or with ceramic on one side, leaving an untreated, cotton side as the top side of the base segment 120 of the ironing board cover 100. This allows for the cover 100 to retain a soft, cotton feel on the top side, while the treated, opposing side enables the cover to reflect and retain heat at a higher rate back to the garment being ironed.

In another embodiment, the base segment 120 may also include textiles in the multiple layers 130 than enables the ironing board cover to "stretch," so that the cover adjusts to multiple sizes of the ironing board in "universal" fit. These materials may include, for example, 95% cotton and 5% latex, which also enables the ironing cover to retain its heat-withstanding properties.

It is to be understood that the cover 100 of the present invention may be used for more than just ironing. For example, the present invention may also be used for steaming and pressing applications, and therefore may be used in professional dry-cleaning environments. Therefore, the present invention is not to be limited to any one application referenced herein.

The present invention may also include a process for coating textiles for the multiple layers 130. The process includes mixing a solution having one or more of small metal particles, aluminum particles, ceramic particles or titanium particles, and coating the textile materials with such a solution. The textiles then go through a backing and drying process to bond them together into the multiple layers 130. In one embodiment, these coated textiles generally form the top layer of the multiple layers 130 of the ironing board cover 100. The multiple layers are then formed with various combinations of foam or fiber layers beneath this layer.

As noted above, the ironing board cover 100 may include a configuration in which a textile-based top portion is made from cotton or wool, and with an aluminum layer underneath this top portion. This aluminum interlay resides between the layers underneath the textile-based top portion, to collect the steam and produce additional heat reflection. Such a configuration may also include a foam layer underneath the interlay.

As noted above, many different kinds of materials may be incorporated into the multiple layers 130, in any combination. The separate layers comprising these multiple layers 130 may all be adhered or laminated together, or partially adhered or laminated together. Regardless, layers are adhered or laminated together to reduce creases or waives on the surface of the ironing board cover 100 which may leave an imprint on a garment being ironed.

Different types of materials for a top portion 130A of the multiple layers include natural cotton, either bleached or unbleached, regular cotton fabric, wool, a metal layer such as an aluminum coating or a titanium coating, and a ceramic coating. An underlying layer beneath this top portion may also include many different types of materials, including foam, fiber, wool, and aluminum interlay forming a full layer of aluminum extending throughout the ironing board cover 100. A foam layer may be incorporated one or more times within the same ironing board cover, so as to form a plurality of layers of this material alone. These foam layers may have different thicknesses and densities. Fiber may be incorporated one or more times within the same ironing board cover, and each fiber layer may also have different thicknesses and densities. A fiber layer may be particularly useful as a bottom layer to provide comfort and cushion when ironing.

The present invention may also include an "X" bungee which is positioned under the second end portion 146 to enable a user to pull the second end portion 146 of the cover 100 tighter in place over the ironing board 110. A cord minder may also be included in the ironing board cover 100, made from either the same material as the cover or from plastic sewn into a side of the thereof, which fits around a power cord of an iron once it is placed on the board. The cord minder may also comprise a small adjustable strap. The present invention may further include a weight that attaches and detaches to any iron cord, so that when the iron is pulled back for example to the iron rest portion 122 of the base segment 120, the weight pulls the cord down to the floor and away from the ironing surface.

An "X" bungee (or alternatively, hook and look fasteners) may also be placed at both the first end portion 140 and the second end portion 146 of the ironing board 110. These allow a user to pull the material at the nose and larger ends of the ironing board cover 100 closer together, for a tighter fit on the ironing board 110.

In another embodiment of the present invention, the ironing board cover 100 may include a section on one end of the base segment 120 thereof which allows a user to wipe the bottom of a hot iron with a lubricant. This enables the iron to glide better on a garment being ironed. The lubricant may be part of the surface of the base segment 100, and may alternatively be built into the multiple layers 130 of the base segment 130, so as to be releasable by the user by, for example, by laying the iron's hot surface down directly onto the cover 100.

The ironing board cover 100 may also incorporate one or more additional fasteners 170 coupled to the bottom segment 150 for easily securing and adjusting the cover 100 to an ironing board 110. These additional fasteners 170 may utilize different mechanisms capable of securing the cover 100 to an ironing board 110. For example, a hook-and-loop structure such as Velcro® may comprise the one or more fasteners. Other embodiments of the present invention may include one or more buckles or keepers, one or more metal or plastic snaps, or any device or mechanism capable of producing a secured attachment means for the cover 100. It is therefore contemplated that the present invention is not to be limited by any one type of mechanism described herein.

In another embodiment, the multiple layers 130 may include a chemical coating that protects the ironing board cover 100 against moisture altogether. Once the chemical has been applied to, for example, a cotton material, water will no longer be absorbed by the cotton, and will roll off of the material. Such a layer may be applied, for example, in commercial settings to extend the lifespan of ironing board covers from damage from stains and other non-ironing moisture spillages.

Figure 5:
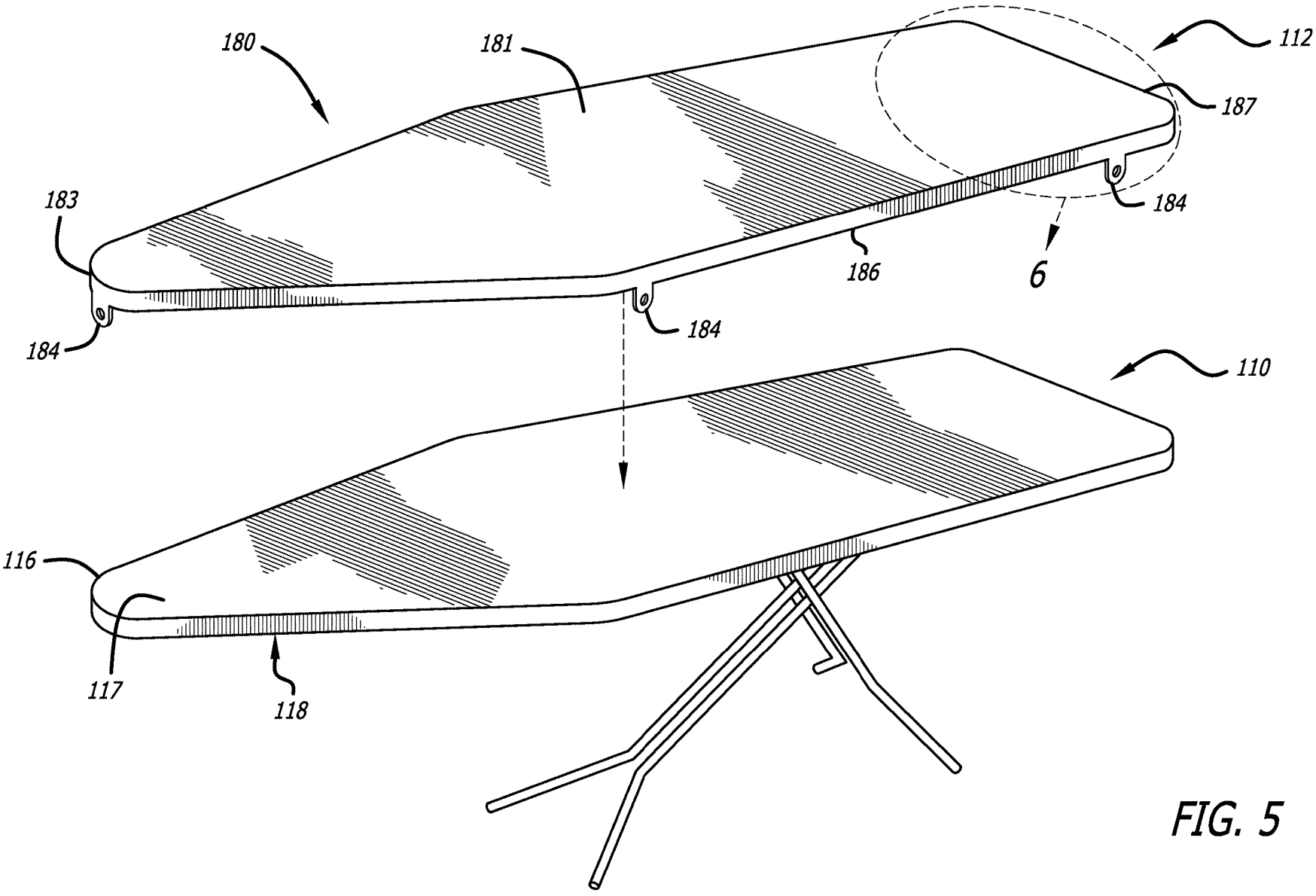
FIG. 5 is a side perspective view of a protective layer and cover for an ironing board according to another embodiment of the present invention.

The present invention further includes, in another embodiment thereof, a protective layer or cover 180 that is placed over the top of an ironing board 110. FIG. 5 illustrates a protective layer 180 for an ironing board 110 according to this embodiment. The protective layer 180 is comprised of a thin silicone overlay 181, and has a smooth surface and a band 183 which serves to grip the sides of the ironing board 110.

Most conventional ironing boards are made from steel or other more inexpensive metals. Some ironing boards are also made with a powder coating in a process of coating metal with a plastic finish applied in powder form and baked to a fluid state to bond it to the metal surface. Others may be coated with other substances to protect against the corrosion which occurs over the lifespan of the product due to normal and frequent use. This, however, simply extends the lifespan of the ironing board, but does not render the materials from which it is made rust-proof. Corrosion generally begins on the top portion or surface of the ironing board and affects the welding points where a mesh top is welded to the main frame, and also where mesh joints are welded. Once rust sets in, the jointed areas start to come apart. Initially, the ironing board's surface becomes uneven, and also starts rendering the ironing board dangerous since the main frame can come apart from the rest of the ironing board at any time thereafter, even during use. Also, once exposed, the edges of the mesh top may be hazardous, as they become sharp and can cut or pierce.

Figure 8:
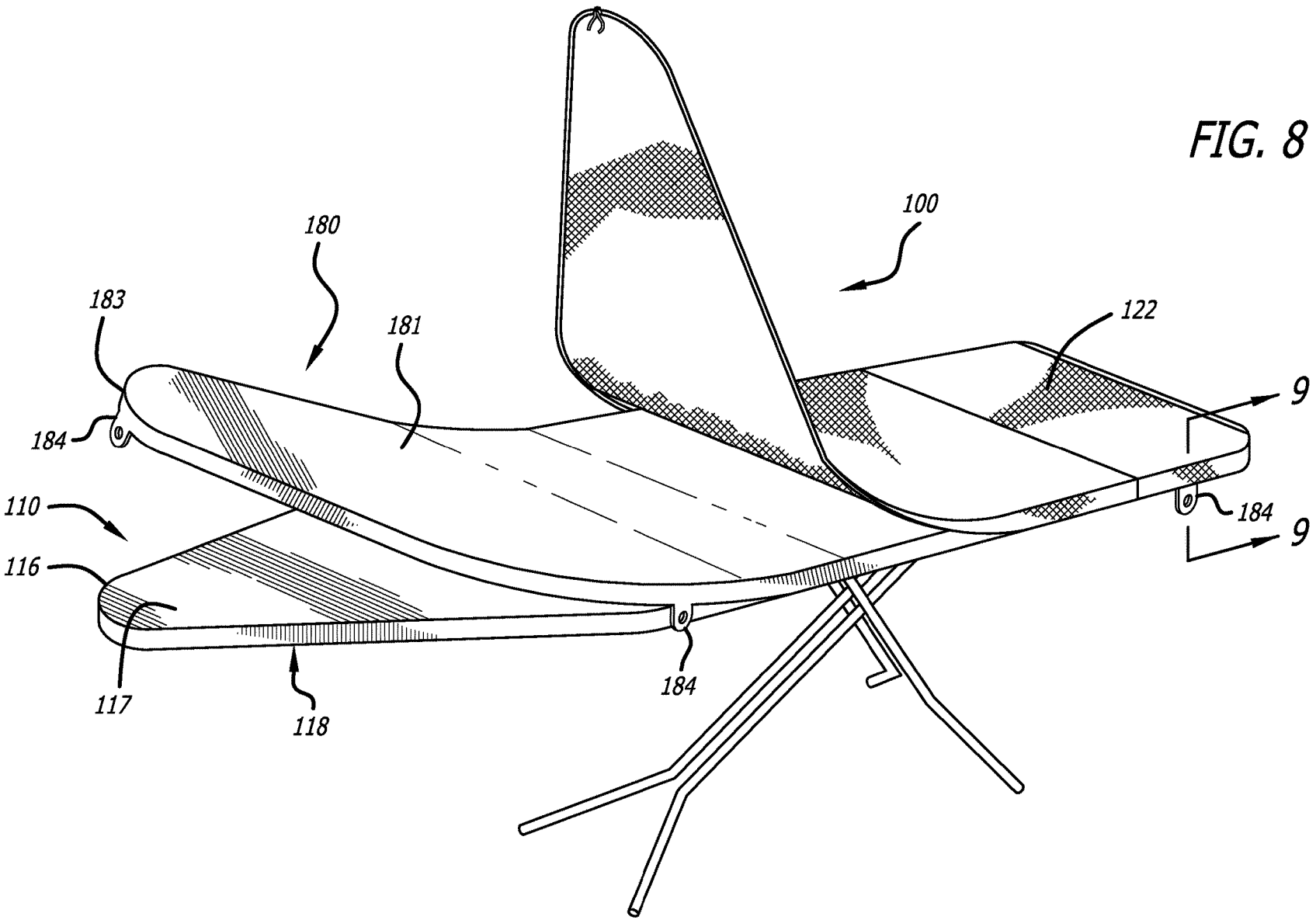
FIG. 8 is side perspective view of a protective layer and cover according to a further embodiment of the present invention.
Figure 9:
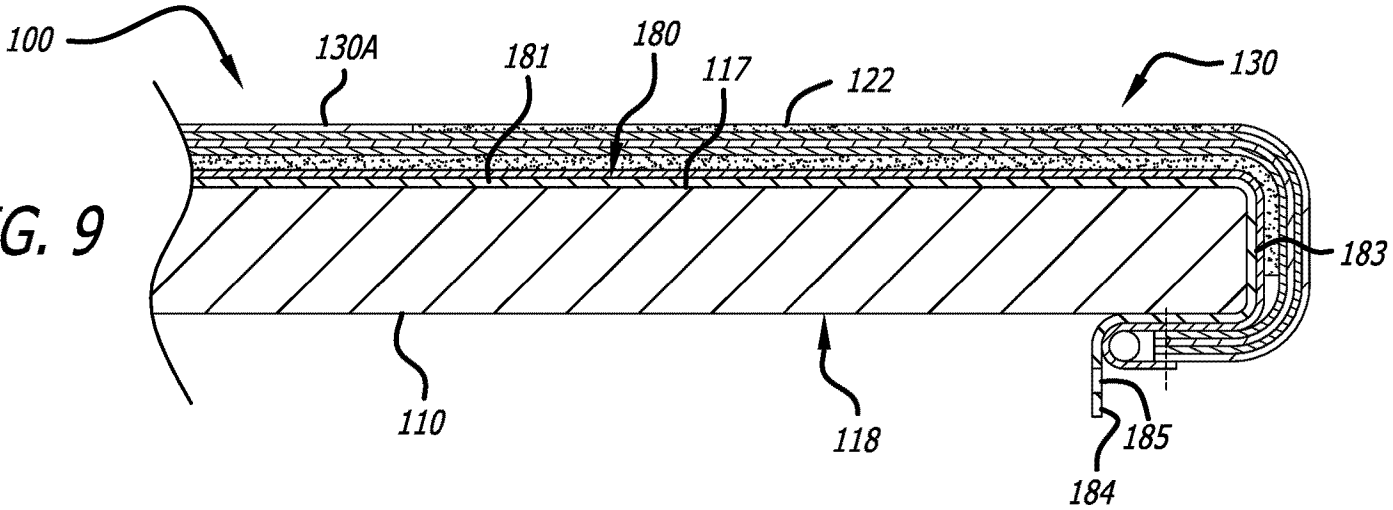
FIG. 9 is a cross-sectional view of one end of a protective layer and cover together with an ironing board cover as indicated in FIG. 8.

The protective layer or cover 180 of the present invention protects the top portion 116 of the ironing board 110 from such problems. The protective layer 180 may be a stand-alone product that can be added to ironing boards 110, or may pre-fabricated with ironing board covers 100 so as to act as an extra layer that lies between the ironing board cover 100 and the mesh of the top portion 116 of the ironing board 110. Further, as noted below, the protective layer 180 may also be fabricated together with the ironing board cover 100. FIG. 8 illustrates a protective layer 180 together with an ironing board cover 100, and FIG. 9 is a cross-sectional view of one end of an ironing board 110 showing the protective layer 180 together with the ironing board cover 100.

Regardless of the configuration, the protective layer 180 tightly wraps around the top portion 116 along an entire upper side 117 of the top portion 116 and at least part of an under side 118 of the top portion 116. The protective layer 180 provides protection against the direct heat and moisture to which the structure of the ironing board 110 is exposed to during use with an iron.

The protective layer 180 is constructed of, in one embodiment thereof, a solid-stretch silicone overlay 181, and may in further embodiments thereof have an underlying layer or patches 182 comprising a foil material, such as aluminum foil. Regardless of whether silicone protective layer 180 is a stand-alone tight wrap for the top portion 116 of the ironing board 110 or is bundled as part of the ironing board cover 100 or as part of the ironing board 110 itself, the protective layer 180 and silicone overlay 181 act as a wrap in that they stretch over the top portion 116 of the ironing board 110 and around edges of the ironing board 110 to at least a portion of the underside 118 of the top portion 116.

Figure 6:
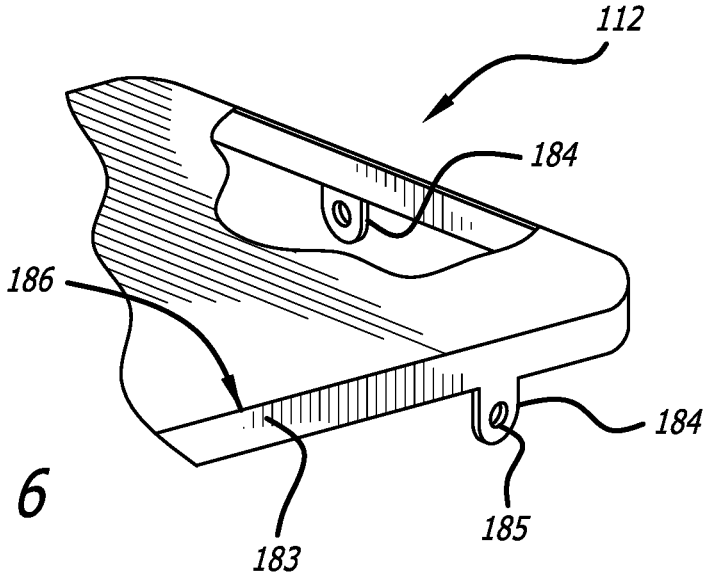
FIG. 6 is a close-up view of a portion of the protective layer and cover of FIG. 5.
Figure 7:
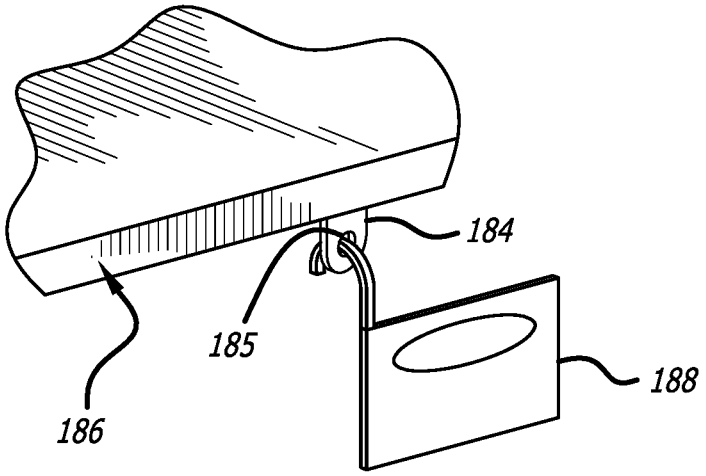
FIG. 7 is a further close-up of a portion of the protective layer and cover of FIG. 5 and FIG. 6 showing additional parts thereof.

FIG. 6 and FIG. 7 are close-up views of illustrates various aspects of the protective layer 180. Portions of the protective layer 180 may be extended to serve other purposes in addition to providing a tight wrap and anti-grip surface that retains and reflects heat and prevents damage from wear and tear to the ironing board 110. For example, the band 183 may comprise one or more pull tabs 184 that extend over and beyond the edges 186 of the silicone overlay 181. The band 183 and pull tabs 184 serve as gripping mechanisms for a tighter coupling to the ironing board 110, and may also be configured so that items may be attached to the protective layer 180. The pull tabs 184 may have holes 185 placed therein, from which items may be hung from the protective layer 180. Pull tab(s) 184 and hole(s) 185 at a back portion 187 of the protective layer 180 (the rear or straight end thereof, and at the large end 112 of the ironing board 110) may allow for a cord of an iron to pass through to mind the cord to keep it at one end of the ironing board 110, instead of moving to the sides of the ironing board 110 or otherwise in the way of the user. FIG. 6 shows a partial fragmented view to illustrate the presence of a pull tab 184 at the large end 112 of the ironing board 110.

Pull tabs 184 may be placed at various points to serve other purposes, such as allowing additional products to be attached to the protective layer 180 in various sizes, shapes, and for different purposes. For example, a hanging portion 188 such as a pouch or pocket, that may hold a remote control or mobile telephone, may be attachable to the pull tabs 184 and hang therefrom via the holes 185. Alternatively, the protective layer 180 may include pre-set holes 185, of either uniform or varying sizes holes, attached directly to the silicone overlay 181, to allow items such as cords for irons to pass through, and from which other items can be hung, such as hangers or such pockets or pouches.

Regardless, these holes 185 may be positioned on the pull tabs 184, and/or around or slightly below edges 186 of the protective layer 180 along the band 183 that is placed over edges of the ironing board 110. Hanging portions 188 as noted above may also extend down from the protective layer 180, either as separate portions or removably coupled to the protective cover 180 via the pull tabs 184, to hold items while the ironing board 110 is in use. Such hanging portions 188 may include, for example, fabric or other materials that form a pocket within which items can be placed.

Figure 10:
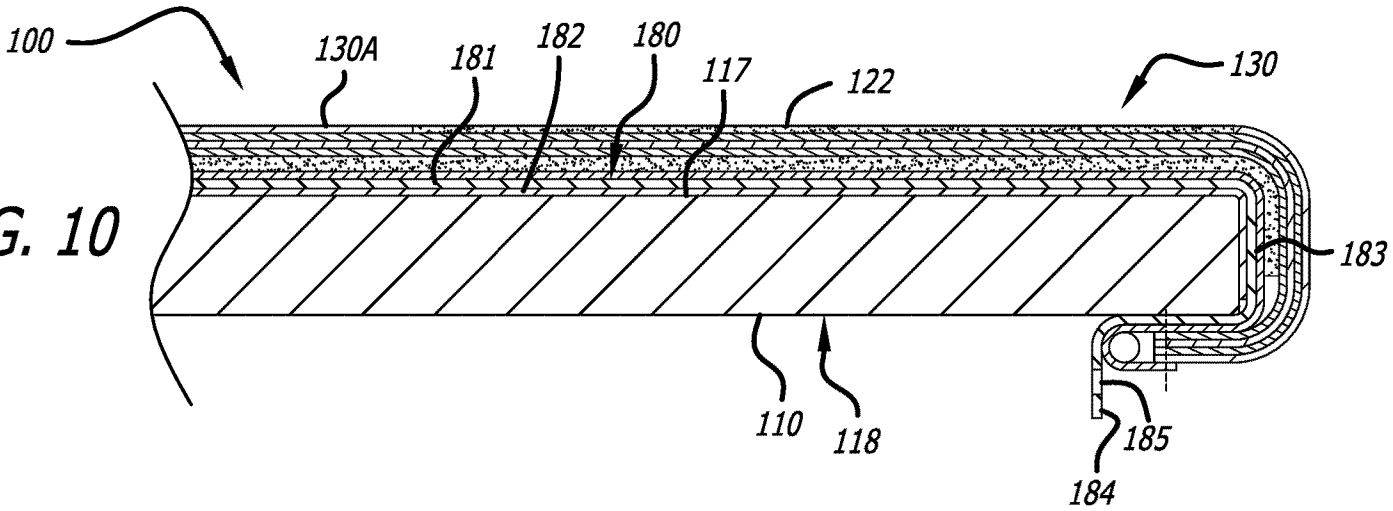
FIG. 10 is a cross-sectional view of one end of a protective layer and cover together with an ironing board cover according to a further embodiment of the present invention.

Instead of (or in addition to) holes 185, other means of attachment for items to the protective layer 180 are also possible, such as by grommets or buttons may be provided to couple hanging items 188 to the pull tabs 184 or otherwise to the silicone overlay 181. The protective cover 180 may further include absorbent strips around its edges 186 and across the top portion 116 of the ironing board 110 to absorb any excess moisture and prevent excess moisture from building up on the surface of the ironing board 110. As noted above, the protective layer 180 may include a single layer 181 comprised of silicone, or multiple layers, for example an overlay 181 of silicone and an underlying layer 182 comprised of a foil, such as aluminum foil. FIG. 10 is a cross-sectional view of one end of an ironing board 110 showing the protective layer 180 and the underlying layer 182. FIG. 10 illustrates an embodiment of the present invention where the protective layer 180 and the underlying layer 182 are provided together with the ironing board cover 100.

In embodiments where an underlying layer 182 is included, the foil underlay 182 produces a higher level of heat reflection than just the single layer of silicone. The foil underlay 182 may extend along the entire underside of the protective layer 180, or may be formed into a plurality of patches.

The protective layer 180 according to this embodiment of the present invention realizes many benefits, whether it is a stand-alone wrap for the top portion 116 of an ironing board 110, or as part of the ironing board cover 100. As noted above, the protective layer 180 protects the ironing board 110 against any rust that results from the presence of steam and moisture from ironing garments. The protective layer 180 also creates a smooth ironing surface, and eliminates the pass-through of an impression of the mesh top or other top surface designs onto garments when they are being ironed. The protective layer 180 provides a very high degree of ironing efficiency as heat from the iron is retained and is returned back to the surface of the ironing board cover 100 through the various layers thereof, rather than dissipating into the top portion 116 of the ironing board 110. The cover's silicone overlay 181 (and the aluminum underlay 182, if included) allow steam to evaporate back up through the ironing board cover 100, which greatly increases speed during the ironing process, and realizes savings in both energy and power consumption.

Other benefits may further be realized using a protective layer 180 according to this embodiment of the present invention. For Example, because steam that is collected re-evaporates up through the ironing board cover 100 and the garments being ironed as noted above, this also means that when ironing or steaming for long periods of time, the user will not experience having droplets of water on the floor underneath the ironing board 110. The protective layer 180 also provides a better surface for the ironing board cover 100 to attach to and grip to. The grip provided by the protective layer 180 assures that the ironing board cover 100 is installed securely and reduces the changes of slippage of the ironing board cover 100 vis-à-vis the top portion 116 of the ironing board 110.

It is to be understood that the protective layer 180 may be comprised of other materials, either in addition to silicone and aluminum foil, or instead of those materials, and in various combinations, thicknesses, and weights. For example, one or both of the overlay 181 or the underlying layer 182 may include a felt material, either by itself or in combination with other materials, to provide padding for the protective cover 180. It is to be further understood that the protective layer 180 according to this embodiment of the present invention is applicable to ironing boards 110 made of any material, and it is not to be limited in applicability to ironing boards may entirely or primarily of metals. For example, some ironing boards are made from either wood, or with wooden top portions, and still others made from plastic, fiberglass, or other synthetic material. The protective layer 180 is also applicable to these types of boards, as it protects the wood, plastic, fiberglass or other non-metal material against pre-mature wear and damage.

In a further embodiment of the present invention, some or all of the protective layer 180 may be sprayed onto an ironing board 110 during a manufacturing process. In one example of such an embodiment, a silicone spray that comprises materials forming all or part of the overlay 181 and underlay 182 is applied to the top surface 116 after manufacturing of the ironing board 110, so that the protective layer 180 is a coating applied thereto.

It is to be further understood that the protective layer 180 is applicable to any type of ironing board, in any configuration and in any shape thereof. For example, some ironing boards are shaped differently—some are rectangular, or are asymmetrical, where the nose is slanted to one side only. The protective layer 180 may therefore be configured for use with any type of ironing board, regardless of shape, including but not limited to ironing tables, wall-mounted boards, built-in cabinet boards, and table-top boards.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. For example, the multiple layers 130 may alternatively be sewn together, such as where natural cotton is used, and no chemicals added. Additionally, the ironing board cover 100 may be configured for use on other products that do not include an ironing board. For example, the cover 100 may be used on countertops or top of washer and dryers, and may include an additional material such as pressed foam on one side thereof to protects such surfaces from moisture, as well as providing an anti-slip material covering. It is therefore intended that the scope of the invention be limited not by this detailed description. For example, notwithstanding the fact that the elements of any claim herein are set forth below in a certain combination, it must be expressly understood that the invention includes other combinations of fewer, more or different elements, which are disclosed in above even when not initially or eventually claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in any claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A protective layer for an ironing board, comprising:

an overlay portion;

an edge that extends over an entirety of sides of a top surface of an ironing board and is configured to grip the sides of the top surface of the ironing board to prevent slippage of the protective layer from the ironing board;

an underlay portion, the underlay portion formed from a layer of aluminum, wherein the layer of aluminum is configured in small patches on an underside of the overlay portion; and a plurality of tabs extending from the edge, and the plurality of tabs each having a hole positioned therein for hanging items from the protective cover, wherein the protective layer is stretchable to fit over the top surface of an ironing board, and wherein the plurality of tabs are positioned on each elongated side of the protective layer and on a back portion of the protective layer.

2. The protective layer of claim 1, wherein at least the overlay portion and the edge are formed from silicone.

3. The protective layer of claim 1, wherein the protective layer is fabricated as a component of an ironing board cover.

4. The protective layer of claim 3, wherein the ironing board is fabricated with the protective layer affixed thereto.

5. The protective layer of claim 1, further comprising one or more hanging portions that extend from the plurality of tabs for hanging items from the protective cover.

6. The protective layer of claim 5, wherein the one or more hanging portions are pockets within which items are placed when the protective layer is affixed to an ironing board.

7. An assembly, comprising:

an ironing board cover having a padded base section comprised of multiple layers of material adhered together to form a smooth, heat-reflective ironing surface for an ironing board; and a protective layer beneath the ironing board cover, the protective layer comprised of an overlay portion, an underlay portion formed from a layer of aluminum, wherein the layer of aluminum is configured in small patches on an underside of the overlay portion, an edge that extends over an entirety of sides of a top surface of the ironing board configured to grip the sides of the top surface of the ironing board to prevent slippage of the assembly from the ironing board, and a plurality of tabs extending from the edge, and the plurality of tabs each having a hole positioned therein for hanging items from the assembly.

8. The assembly of claim 7, wherein the protective layer is stretchable to fit over the top surface of an ironing board, and wherein the plurality of tabs are positioned on each elongated side of the protective cover and on a back portion of the protective cover.

9. The assembly of claim 7, wherein the protective layer is formed from silicone.

10. The assembly of claim 7, further comprising one or more hanging portions that from the plurality of tabs for hanging items from the protective cover.

11. The assembly of claim 10, wherein the one or more hanging portions are pockets within which items are placed when the assembly is affixed to an ironing board.

* * * * *